US008696416B1

(12) United States Patent
Arnold, Jr.

(10) Patent No.: US 8,696,416 B1
(45) Date of Patent: Apr. 15, 2014

(54) MULTI-PURPOSE CHIMNEY CAP DEVICE

(75) Inventor: John G. Arnold, Jr., Tulsa, OK (US)

(73) Assignee: European Copper, LLC, Tulsa, OK (US)

( * ) Notice: Subject to any disclaimer, the term of this patent is extended or adjusted under 35 U.S.C. 154(b) by 303 days.

(21) Appl. No.: 12/861,191

(22) Filed: Aug. 23, 2010

Related U.S. Application Data

(60) Provisional application No. 61/235,881, filed on Aug. 21, 2009.

(51) Int. Cl.
*F23L 17/04* (2006.01)

(52) U.S. Cl.
USPC ..... 454/8; 454/12

(58) Field of Classification Search
USPC ..... 454/12, 8
See application file for complete search history.

(56) References Cited

U.S. PATENT DOCUMENTS

| | | | | |
|---|---|---|---|---|
| 638,172 | A | | 11/1899 | Burress |
| 847,255 | A | | 3/1907 | Kobusch |
| 1,627,105 | A | | 5/1927 | Meier |
| 1,644,701 | A | | 10/1927 | Anderson |
| 2,381,178 | A | | 8/1945 | Munyon |
| 2,763,196 | A | | 9/1956 | Singleton |
| 2,856,837 | A | | 10/1958 | Thulman |
| 2,966,838 | A | * | 1/1961 | Thompson et al. ..... 454/8 |
| 3,012,495 | A | * | 12/1961 | Miller ..... 454/344 |
| 3,022,717 | A | * | 2/1962 | Webster ..... 454/4 |
| 3,103,158 | A | | 9/1963 | Noll |
| D203,632 | S | | 2/1966 | Carpino |
| 3,269,296 | A | | 8/1966 | Best |
| 3,327,609 | A | * | 6/1967 | Sage et al. ..... 454/8 |
| 3,782,303 | A | * | 1/1974 | Pfister et al. ..... 110/162 |
| 3,817,162 | A | | 6/1974 | Guelph |
| 4,106,290 | A | * | 8/1978 | Johnson ..... 60/324 |
| 4,286,975 | A | | 9/1981 | Whiteley |
| 4,608,963 | A | * | 9/1986 | Townsend et al. ..... 126/307 R |
| 4,683,687 | A | * | 8/1987 | Crider ..... 52/72 |
| 4,732,078 | A | | 3/1988 | Giumenta et al. |
| D299,529 | S | | 1/1989 | Best |
| 4,815,934 | A | * | 3/1989 | Rademaker ..... 415/191 |
| 5,070,772 | A | * | 12/1991 | Guzorek ..... 454/16 |
| 5,125,198 | A | | 6/1992 | Giumenta et al. |
| 5,402,613 | A | | 4/1995 | Giumenta et al. |
| D396,100 | S | | 7/1998 | Brummer |
| 6,093,098 | A | * | 7/2000 | Wilhelmson ..... 454/365 |

(Continued)

FOREIGN PATENT DOCUMENTS

| | | | |
|---|---|---|---|
| JP | 02058904 | A * | 2/1990 |
| JP | 02058904 | A * | 2/1990 |

*Primary Examiner* — Kang Hu
*Assistant Examiner* — Jonathan Cotov
(74) *Attorney, Agent, or Firm* — Head, Johnson & Kachigian, P.C.

(57) ABSTRACT

A multi-purpose chimney cap device for a flue opening. The device includes a tubular housing with an open lower end surrounding the flue opening and an open upper end. A plurality of ventilation openings in the lower portion of the tubular housing draws air into the tubular housing. A plurality of exit openings are provided near the open upper end of the tubular housing. A removable heat deflector is attached to the open upper end of the tubular housing. A removable non-metal weather shield is fastened to the heat deflector to provide an enclosed chamber between the weather shield and the heat deflector. A receiver/transmitter within the enclosed chamber resides between the weather shield and the heat deflector.

12 Claims, 6 Drawing Sheets

(56) References Cited

U.S. PATENT DOCUMENTS

| | | | | |
|---|---|---|---|---|
| 6,152,817 | A | 11/2000 | Daniels et al. | |
| 6,283,850 | B1 * | 9/2001 | Toshimitsu et al. | 454/184 |
| D488,550 | S | 4/2004 | Taylor | |
| 6,805,627 | B2 * | 10/2004 | Marts et al. | 454/368 |
| D503,471 | S | 3/2005 | Huta | |
| 6,926,600 | B1 | 8/2005 | Arnold, Jr. | |
| D535,010 | S | 1/2007 | Arnold, Jr. | |
| 7,179,164 | B2 | 2/2007 | Arnold, Jr. | |
| D574,944 | S | 8/2008 | Arnold, Jr. | |
| D583,458 | S | 12/2008 | Arnold, Jr. | |
| 7,458,888 | B2 * | 12/2008 | Huta | 454/37 |
| D584,395 | S | 1/2009 | Arnold, Jr. | |
| D592,298 | S | 5/2009 | Arnold, Jr. | |
| D593,671 | S | 6/2009 | Arnold, Jr. | |
| D605,749 | S | 12/2009 | Arnold, Jr. | |
| D619,237 | S | 7/2010 | Arnold, Jr. | |
| 2006/0111034 | A1 * | 5/2006 | Parry | 454/3 |
| 2006/0246833 | A1 * | 11/2006 | Arnold, Jr. | 454/12 |

* cited by examiner

MULTI-PURPOSE CHIMNEY CAP DEVICE

CROSS-REFERENCE

This application claims priority to U.S. Provisional Patent Application Ser. No. 61/235,881, filed Aug. 21, 2009, incorporated in its entirety herein by reference.

BACKGROUND OF THE INVENTION

1. Field of the Invention

The present invention is directed to a multi-purpose chimney cap for a flue opening. In particular, the present invention is directed to a chimney cap device which enhances draw of smoke, protects the chimney and flue from the elements and from the entry of animals and debris, provides a decorative external building feature, and provides a protected enclosure for electronics, such as a satellite transmitter/receiver.

2. Prior Art

Various types of chimney cap covers and shrouds have been implemented over the years. Examples of chimney cap devices include Applicant's U.S. Pat. No. 6,926,600 and U.S. Pat. No. 7,179,164.

Additionally, satellite transmitter/receiver devices have become common place additions to roof tops for television and data reception. A wide range of data and communications are transmitted and received through these devices. Satellite television signals are one example. Transmitting antenna in the form of an uplink satellite dish is located at a upload link facility. The uplink satellite dish is pointed toward a specific satellite. Uplink signals are transmitted within a specific frequency range to be received by a transponder tuned to that frequency range aboard the satellite. The transponder, in turn, retransmits the signal back to earth in a signal path known as the downlink.

The downlink satellite signal is collected by a receiving plate or parabolic dish. A low-noise block downconverter amplifies the signal, filters the block of frequencies in which the satellite television signals are transmitted and converts the block of frequencies to a lower frequency range. A cable, such as a coaxial cable, is provided from a small satellite dish mounted on a roof or wall into the building to a set-top box which demodulates and converts the signals to a desired output form for television, audio or data.

While the satellite transmitters/receivers serve their intended purpose, they are unsightly additions. Additionally, they are subject to wind and weather damage.

Accordingly, it would be desirable to provide a multiple purpose chimney cap device that encloses a satellite transmitter/receiver.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
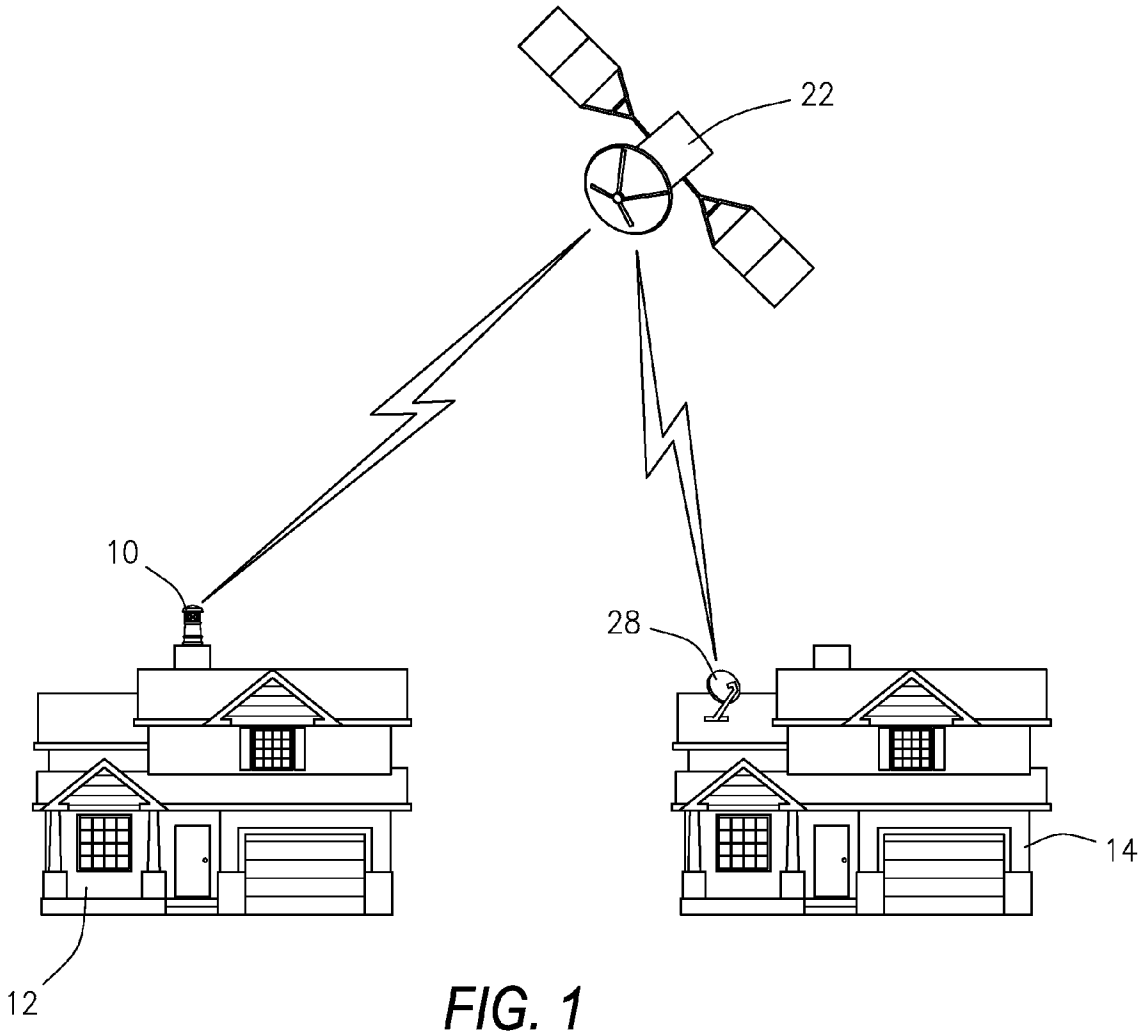
FIG. 1 illustrates a perspective view of two buildings, one with the multi-purpose chimney cap device of the present invention and another building without the present invention.

FIG. 1 illustrates a perspective view of two buildings 12 and 14, in the present case residential homes, utilizing satellite dishes. It will be understood that the present invention may be utilized with a wide range of buildings.

The building 12 on the left in FIG. 1 shows a multi-purpose chimney cap 10 device having a receiver/transmitter constructed in accordance with the present invention installed on the top of a chimney 24. The other building 14 to the right in FIG. 1 includes a typical roof or wall mounted electronic transmitter/receiver 28. The present invention 10 may be mounted on the top end of a chimney 24 at or near the highest point of the building to provide a wide receiving or transmitting field to towers, satellites, or other communicating electronics. In the configuration shown in FIG. 1, the electronic receiver/transmitter communicates with a satellite 22.

Cables (not shown) would be run from inside of the building 12 to and into the chimney cap device 10 as will be explained herein in detail.

Figure 2:
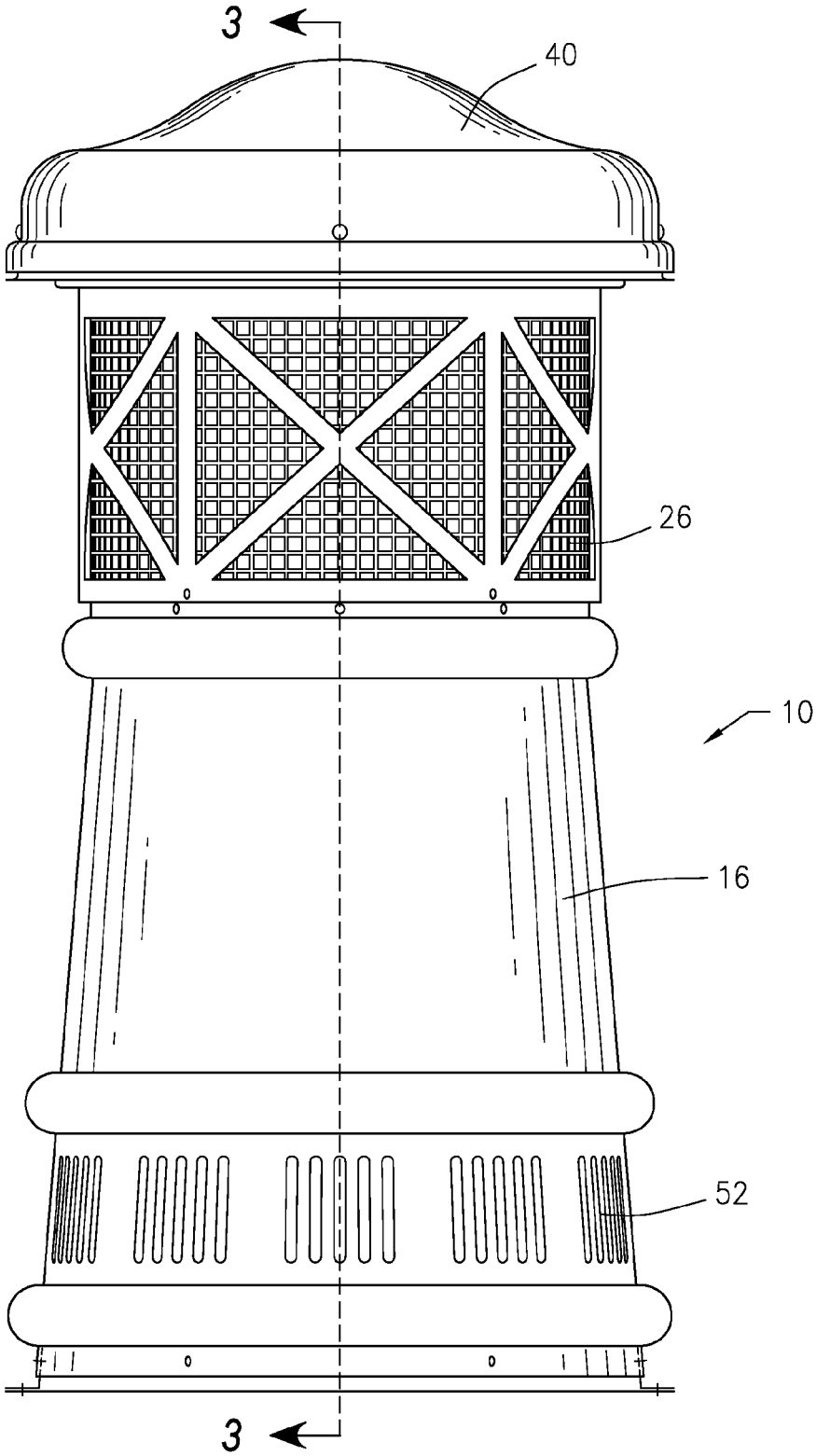
FIG. 2 illustrates an elevational view of a multi-purpose chimney cap device constructed in accordance with the present invention.
Figure 3:
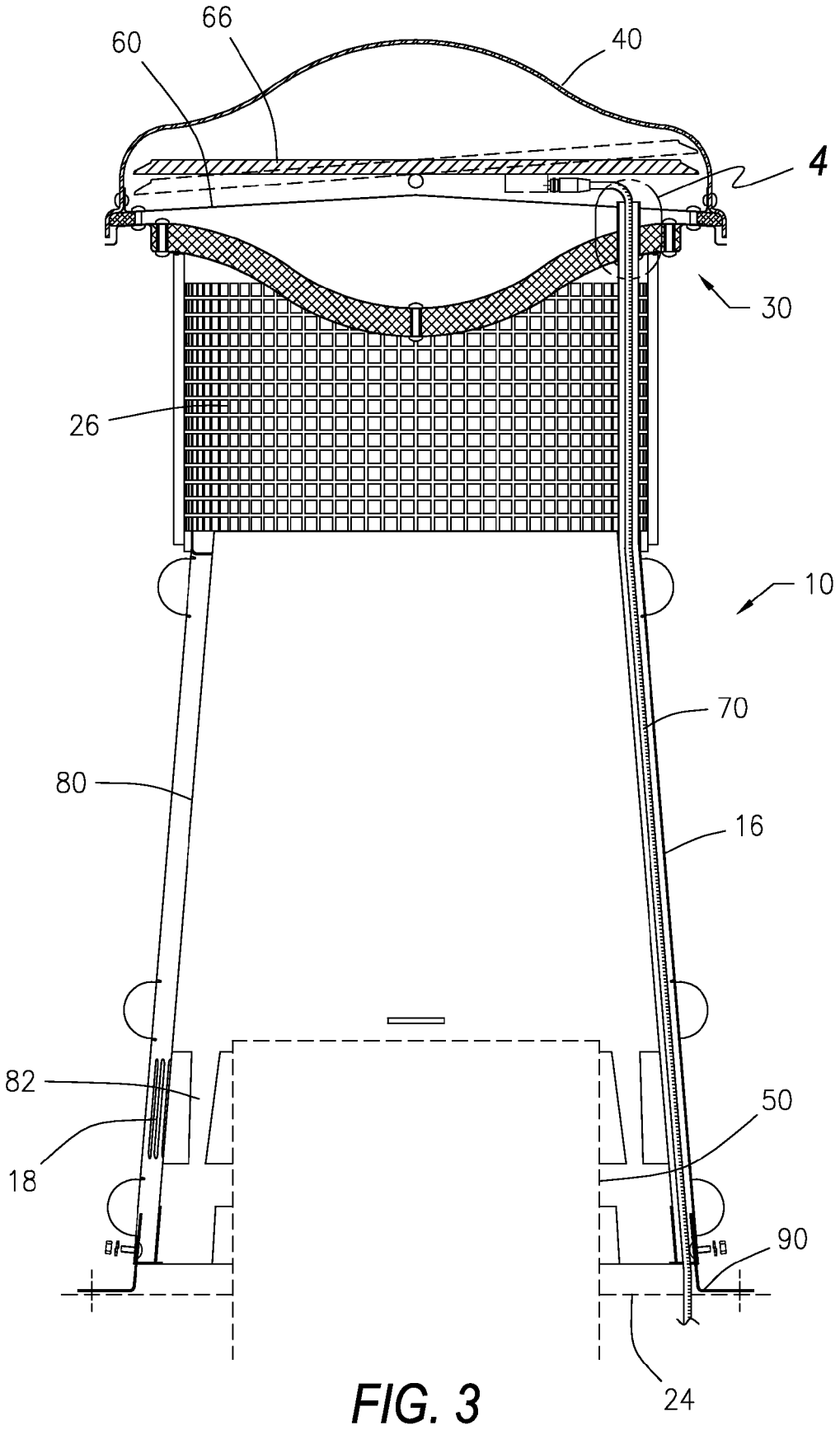
FIG. 3 illustrates a sectional view of the multi-purpose chimney cap device taken along section lines 3-3 of FIG. 2.

FIG. 2 illustrates an elevational view of the multi-purpose chimney cap device 10 while FIG. 3 illustrates a sectional view of the device 10 shown in FIG. 2 attached to a top of a chimney 24. A tubular housing 16 includes an open lower end which surrounds a flue opening 50 (shown in dashed lines). Accordingly, smoke and other gases escaping from the flue opening 50 will be delivered into the tubular housing 16 of the device 10. The tubular housing 16 is frustoconical and may be fabricated from flat sheet metal or other lightweight material. The tubular housing may have a circular, octagon, hexagon, square, rectangular, oval or other cross-section.

The present invention will rest upon and be fastened to the top of a chimney 24 (seen in dashed lines in FIG. 3). The present invention may be used with a wide variety of flue openings and flue pipe configurations within the spirit and scope of the invention.

A plurality of ventilation openings 18 are provided in the lower portion of the tubular housing 16 in order to draw ambient atmospheric air into the tubular housing 16 and mix with exhaust gases.

The tubular housing 16 also includes an open upper end opposed to the lower end. A plurality of exit openings 26 are provided near the open upper end of the tubular housing 16 to allow smoke and the atmospheric air to exit from the device 10. Accordingly, exhaust gases which pass through and out of the flue 50 will proceed upward through the tubular housing 16 and out of the exit openings 26.

A removable heat deflector assembly 30 is attached to the open upper end of the tubular housing 16 to form a closed top.

The heat deflector assembly 30 includes a bottom support plate 32, a top support plate 34 and an insulation layer 36. In the present embodiment, the heat deflector assembly 30 is in the shape of an inverse dome with a portion recessed into the tubular housing 16. The bottom and top plates of the heat deflector assembly 30 may be fashioned from metal or other material. The heat deflector assembly 30 also assists in creating turbulence in the exhaust gases and air and assists in directing the exhaust gases and air out of the exit openings 26.

Referring to FIG. 3, an inner metal liner 80 is located within and spaced from the tubular housing 16. An opening or openings 82 are provided through the liner 80 adjacent the ventilation openings 18 so that atmospheric air passes into the tubular housing 16. The space between the housing 16 and liner 80 acts to insulate the housing 16 from heat.

Referring to FIGS. 2 and 3, the chimney cap device 10 also includes an inner frame and mounting assembly 90 attached near the open lower end of the tubular housing 20. The inner frame and mounting assembly 90 includes an anchoring and leveling mechanism to anchor the inner frame and mounting assembly to the building (not shown in FIGS. 2 and 3). In particular, in the present embodiment, the anchoring and leveling mechanism is used to anchor the inner frame and mounting assembly to the chimney 24.

One embodiment of an inner frame and mounting assembly 90 is disclosed in detail in Assignee's U.S. Pat. No. 7,179,164 and U.S. Pat. No. 6,926,600, which are incorporated herein by reference.

A removable, non-metal weather shield 40 is fastened to the device 10 as will be described. In the present embodiment, the weather shield 40 is formed from a composite material and includes a raised central portion and a downwardly extending lip although other configurations are possible. The heat deflector assembly 30 and the weather shield 40 together form an enclosed chamber, as readily seen in FIG. 3. A mounting plate 60 is located between the heat deflector assembly 30 and the weather shield 40 in the enclosed. A receiver/transmitter 66 is located within the enclosed chamber and secured to the mounting plate 60.

One type of receiver/transmitter 66 suited for the present invention would be an antenna to receive data or transmissions or broadcasts from a satellite and also send data or transmission. The transmitter/receiver 66 includes a parabolic dish which conducts signals to a converter which converts signals from electromagnetic or radio waves to electrical signals.

Because the weather shield 40 is composed of a non-metallic material, it does not interfere with the transmission or reception of signals to or from the receiver/transmitter 28.

When the device 10 is mounted on a chimney 24, the electronics in the receiver/transmitter 28 are maintained in a relatively waterproof environment at one of the highest points of the building.

A conduit 70 is provided from the enclosed chamber through the heat deflector assembly 30 and through the interior of the tubular housing 16. In the embodiment shown, the conduit 70 passes between the tubular housing 16 and the inner liner 80. The conduit 70 may then continue along the inside or outside of the chimney 24, down into the building. In one non-limiting example, the conduit 70 is directed to a set top box (not shown) which operates in conjunction with a television display (not shown).

Figure 4A:
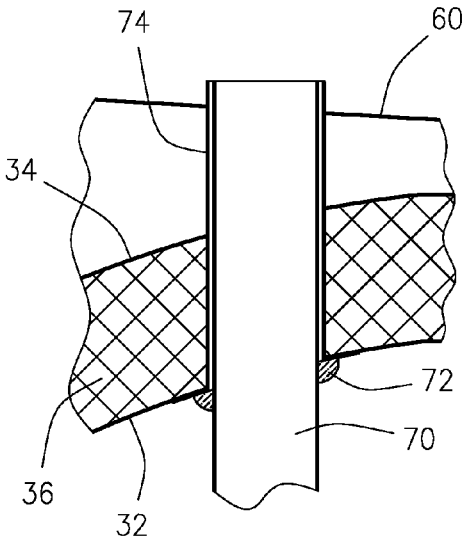
FIGS. 4*a* and 4*b* illustrate enlarged views of a portion of the device shown in dashed lines in FIG. 3.
Figure 4B:
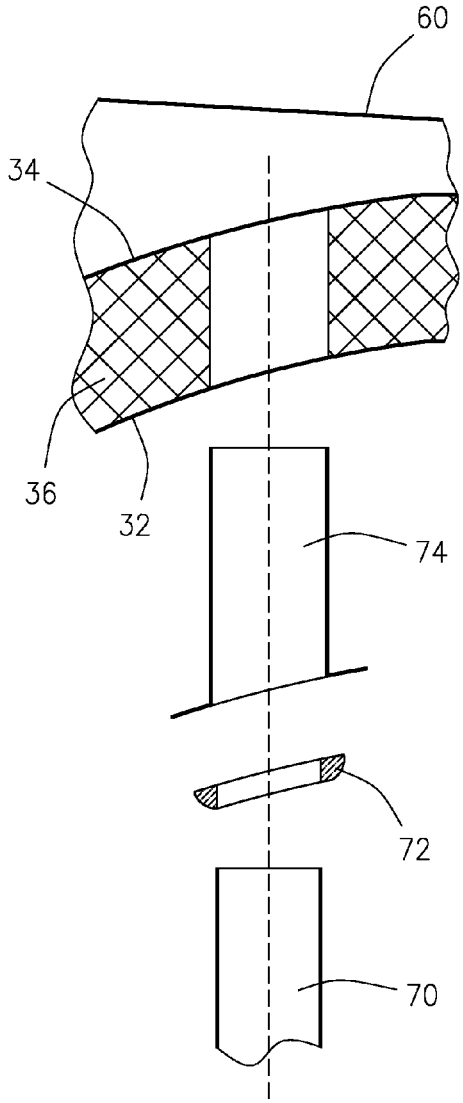

Referring to FIG. 4*a* which shows an enlarged portion of the device 10 shown in dashed lines in FIG. 3 and referring to FIG. 4*b* showing an exploded view of the elements in FIG. 4*a*, a conduit sleeve 74 is inserted through an opening in the heat deflector assembly 30, through the bottom support plate 32, the insulation layer 36 is in the top support plate 34. A grommet 72 forms a seal between the conduit 70 and the conduit sleeve 74 in order to maintain the enclosed chamber.

Figure 5:
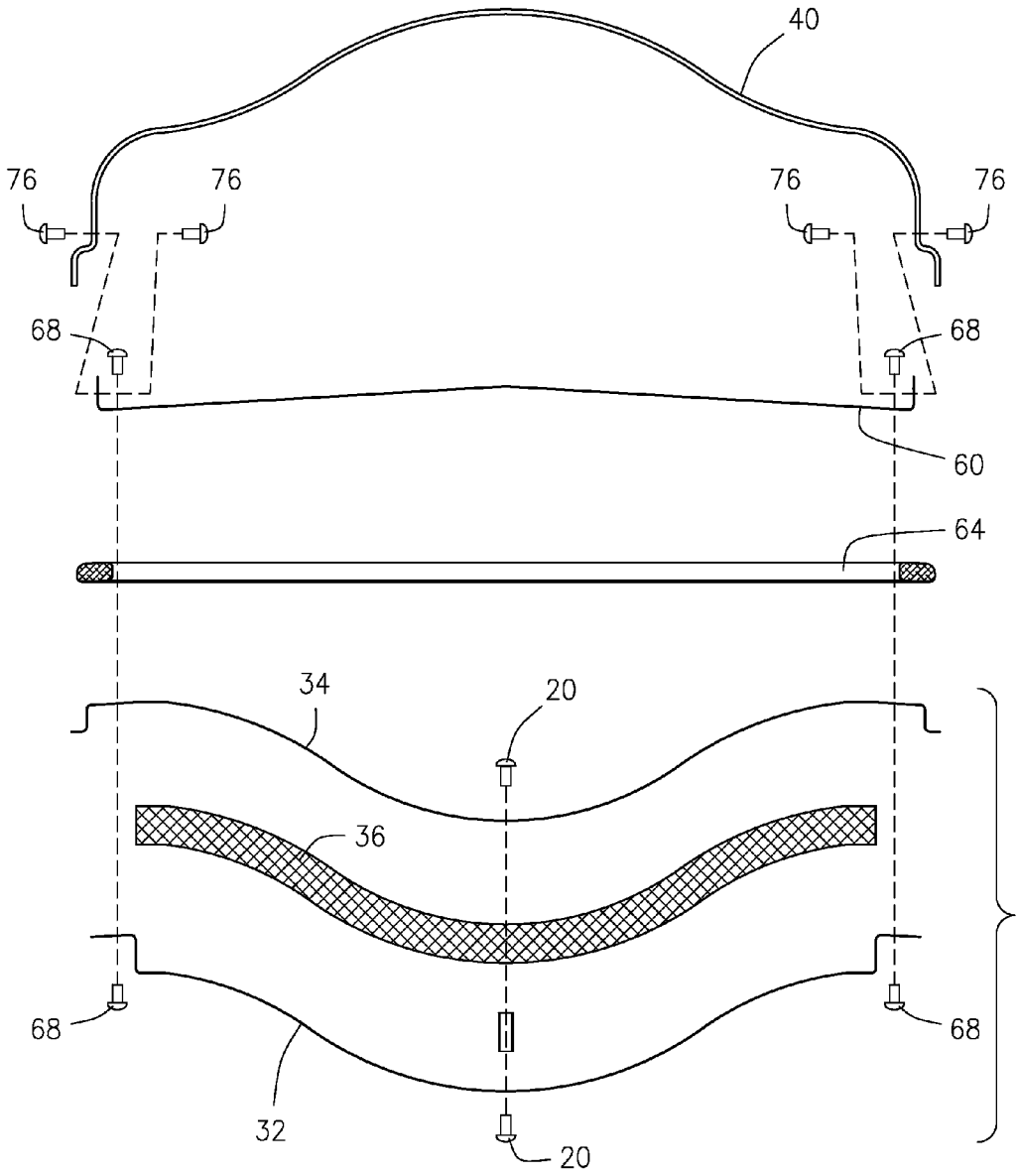
FIG. 5 is an exploded view of a portion of the multiple-purpose chimney cap device shown in FIGS. 2 through 4.

FIG. 5 illustrates an exploded view of the weather shield 40, mounting plate 60 and heat deflector assembly 30 that together form the enclosed chamber of the device 10.

The bottom support plate 32, the top support plate 34 and the insulation layer therebetween 36 are held and retained together by fasteners or rivets 20. The mounting plate 60 is located between the heat deflector assembly 30 and the weather shield 40 within the enclosed chamber.

Figure 7:
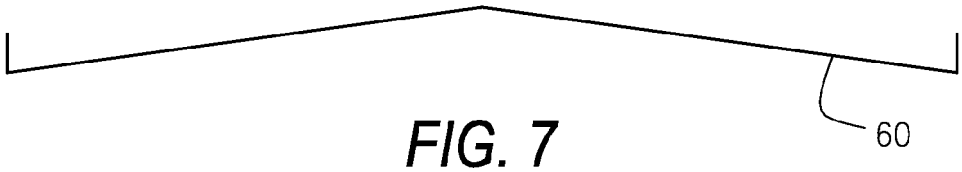
FIG. 7 is a sectional view taken along section line 7-7 of FIG. 6.
Figure 6:
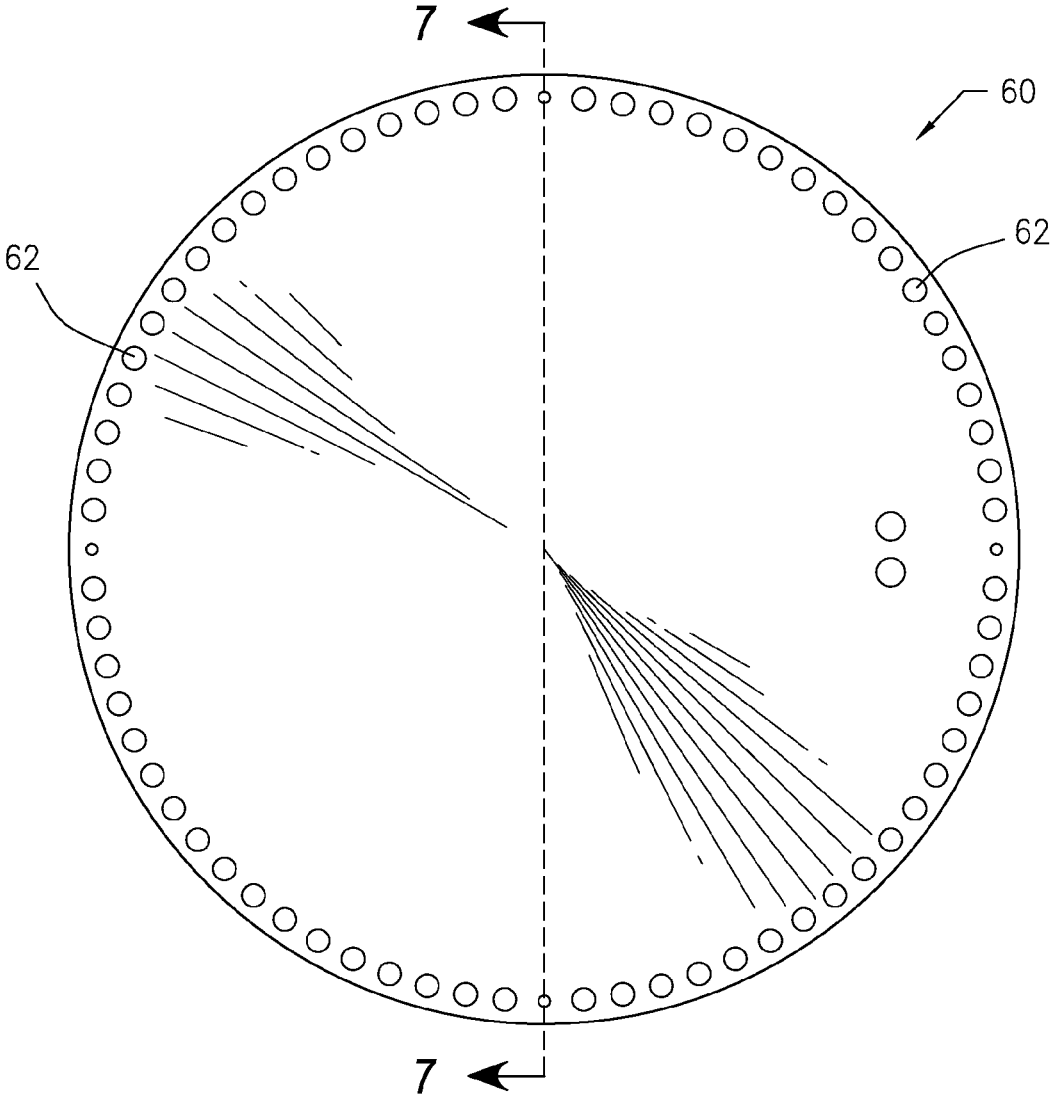
FIG. 6 illustrates a top view of mounting plate of the multi-purpose chimney cap device of the present invention.

FIG. 6 shows a top view of the mounting plate 60 while FIG. 7 illustrates a sectional view through section lines 7-7 of FIG. 6. The mounting plate 60 is substantially circular and includes an upturned circumferential edge, as best seen in FIG. 7. A plurality of vent holes 62 are located near the circumferential edge. Additionally, the center of the mounting plate 60 is slightly higher than the edges so that any moisture that may accumulate within the enclosed chamber will migrate to the edges and through the vent holes 62. A filter ring 64 fabricated from mesh or other similar material is located between the top support plate 34 of the heat deflector assembly and the mounting plate 60. The filter ring 64 is aligned with the vent holes 62 of the mounting plate 60. The filter ring 64 is held in place with a plurality of fasteners 68 passed through openings in the mounting plate 60 and through openings in the top support plate 34 of the heat deflector assembly 30. Accordingly, the filter ring 64 will prevent birds, animals, or debris from entering the enclosed chamber but permit moisture to leave the chamber.

Finally, fasteners, such as rivets 76 secure the downturned edge of the heat deflector assembly 30 to the upturned edge of the mounting plate 60.

The teachings of the present invention might also be employed with other roof top devices, such as cupolas (not shown).

Whereas, the present invention has been described in relation to the drawings attached hereto, it should be understood that other and further modifications, apart from those shown or suggested herein, may be made within the spirit and scope of this invention.

What is claimed is:

1. A multi-purpose chimney cap device for a flue opening, which device comprises:

a tubular housing with an open lower end surrounding said flue opening to receive escaping flue gases, and an open upper end;

a plurality of ventilation openings in the lower portion of said tubular housing to draw air into said tubular housing;

a plurality of exit openings near said open upper end of said tubular housing for exit of said flue gases and said air from said tubular housing;

a removable heat deflector assembly in the shape of an inverse dome attached to said open upper end of said tubular housing wherein said heat deflector assembly includes a bottom support plate, a top support plate and an insulation layer therebetween;

a removable non-metal weather shield fastened to said heat deflector assembly;

a mounting plate between said weather shield and said heat deflector assembly, wherein said mounting plate is circular with an upturned circumferential edge, and a plurality of vent holes near said circumferential edge;

an enclosed chamber between said weather shield and said heat deflector assembly; and a receiver/transmitter within said enclosed chamber between said weather shield and said heat deflector assembly.

2. A multi-purpose chimney cap device as set forth in claim 1 wherein said weather shield is formed from composite material and includes a raised central portion and an outwardly and downwardly extending lip.

3. A multi-purpose chimney cap device as set forth in claim 1 wherein said bottom support plate, said insulation layer and said top support plate are retained together by fasteners or rivets.

4. A multi-purpose chimney cap device as set forth in claim 1 wherein said tubular housing is frusto-conical.

5. A multi-purpose chimney cap device as set forth in claim 1 including an inner tubular liner within and spaced from said tubular housing.

6. A multi-purpose chimney cap device as set forth in claim 1 wherein said tubular housing has a cross-section chosen from the group consisting of an octagon, a hexagon, a square, a rectangle, an oval, or a circle.

7. A multi-purpose chimney cap device as set forth in claim 1 including an inner frame and mounting assembly attached near said open lower end of said tubular housing having anchoring and leveling means to anchor said inner frame and mounting assembly.

8. A multi-purpose chimney cap device as set forth in claim 7 wherein said inner frame and mounting assembly includes receptacles and wherein said anchoring and leveling means includes a plurality of clips receivable in said receptacles.

9. A multi-purpose chimney cap device as set forth in claim 1 including a heat resistant conduit from said enclosed chamber through said tubular housing.

10. A multi-purpose roof top device, which device comprises:

a tubular housing with an open lower end and an open upper end;

a plurality of exit openings near said open upper end of said tubular housing, for exit of air from said tubular housing;

a removable heat deflector assembly in the shape of an inverse dome attached to said open upper end of said tubular housing wherein said heat deflector assembly includes a bottom support plate, a top support plate, and an insulation layer therebetween;

a removable non-metal weather shield fastened to said heat deflector;

a mounting plate between said weather shield and said heat deflector assembly, which said mounting plate is circular with an upturned circumferential edge, and a plurality of vent holes near said circumferential edge;

an enclosed chamber between said weather shield and said heat deflector assembly; and a receiver/transmitter within said enclosed chamber between said weather shield and said heat deflector assembly.

11. A multi-purpose roof top device as set forth in claim 10 including a filter ring between said heat deflector assembly and plate wherein said mounting plate includes a plurality of drain holes to permit moisture to escape from said enclosed chamber and prevent debris or material from entering said enclosed chamber.

12. A multi-purpose roof top device as set forth in claim 10 wherein said weather shield is formed from composite material and includes a raised central portion and an outwardly and downwardly extending lip.

* * * * *